United States Patent [19]

Lange et al.

[11] Patent Number: 4,854,755

[45] Date of Patent: Aug. 8, 1989

[54] RELOADABLE RIBBON CASSETTE SYSTEM

[75] Inventors: Heinz Lange; Hans-Peter Heins, both of Wilhenmshaven; Hermann Jendricke, Varel, all of Fed. Rep. of Germany

[73] Assignee: AEG Olympia Aktiengesellschaft, Wilhelmshaven, Fed. Rep. of Germany

[21] Appl. No.: 157,200

[22] Filed: Feb. 18, 1988

[30] Foreign Application Priority Data

Feb. 18, 1987 [DE] Fed. Rep. of Germany ..... 3705058
Dec. 17, 1987 [DE] Fed. Rep. of Germany ..... 3742860

[51] Int. Cl.[4] ..... B41J 32/00

[52] U.S. Cl. ..... 400/208.1; 400/208; 400/228; 400/238; 400/250; 242/74.1

[58] Field of Search ..... 400/208.1, 207, 208, 400/228, 242, 250, 238; 242/74, 74.1, 74.2

[56] References Cited

U.S. PATENT DOCUMENTS

| | | | |
|---|---|---|---|
| 272,090 | 2/1883 | Schmoele | 242/74.1 |
| 1,902,007 | 3/1933 | Wood | 400/242 |
| 2,178,346 | 10/1939 | Mulch | 242/74.1 |
| 2,366,147 | 12/1944 | May | 400/242 |
| 3,352,169 | 11/1967 | Delin et al. | 242/74.2 |
| 3,731,781 | 5/1973 | Caudill et al. | 400/208 |
| 4,010,839 | 3/1977 | Guerrini et al. | 400/207 |
| 4,213,715 | 7/1980 | Aftmann et al. | 400/207 |
| 4,265,553 | 5/1981 | Hatsell | 400/250 |
| 4,368,992 | 1/1983 | Gagnebin | 400/208 |
| 4,609,298 | 9/1986 | Shioda | 400/208 |
| 4,623,273 | 11/1986 | Gubau | 400/208 |
| 4,780,010 | 10/1988 | Behrens et al. | 400/208 |

FOREIGN PATENT DOCUMENTS

| | | | |
|---|---|---|---|
| 0164003 | 12/1985 | European Pat. Off. | 242/74 |
| 2618308 | 11/1977 | Fed. Rep. of Germany | 242/77 |
| 2951610 | 7/1981 | Fed. Rep. of Germany | 400/208.1 |
| 3524057 | 1/1987 | Fed. Rep. of Germany | 400/208 |
| 3524730 | 1/1987 | Fed. Rep. of Germany | 400/228 |

*Primary Examiner*—Edgas S. Burr
*Assistant Examiner*—Kimberly L. Asher
*Attorney, Agent, or Firm*—Spencer & Frank

[57] ABSTRACT

A reloadable ribbon cassette system for typewriters or office machines of similar construction employs a housing which receives an exchangeable supply spool for the ribbon and an exchangeable take-up spool core. To facilitate the reloading process, the take-up spool core is mounted in the housing on a bearing pin which extends upward from a contact surface. The take-up spool core has a bearing bore into which the bearing pin extends and a bearing surface which rests on the contact surface. The contact surface is disposed closely below a receiving bore in the take-up spool core which accommodates a fastening element attached to the end of the ribbon.

28 Claims, 3 Drawing Sheets

FIG. 4
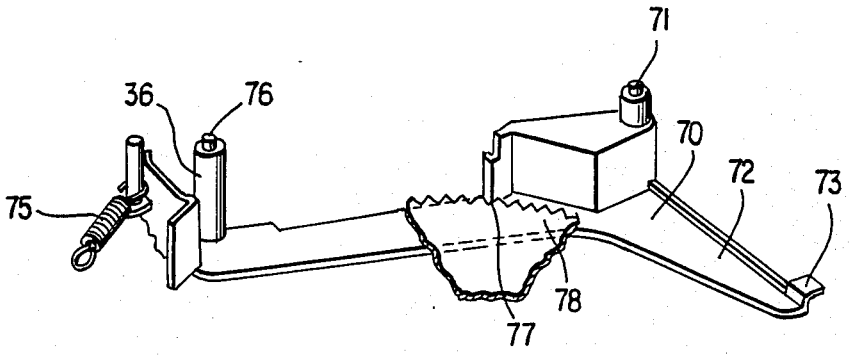
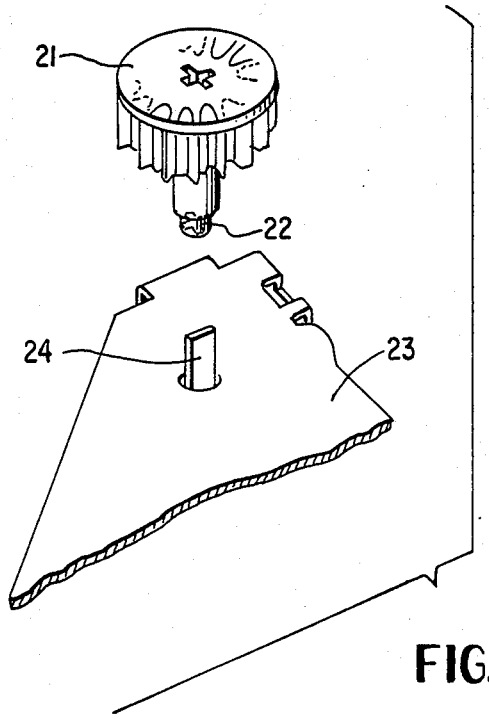
FIG. 5

RELOADABLE RIBBON CASSETTE SYSTEM

CROSS REFERENCE TO RELATED APPLICATION

The subject matter of the present application is related to that of an application filed concurrently herewith by Hans-Peter Heins, Alfred Keiter, and Hermann Jendricke under attorney's docket number OLYMP-0224, both the present application and the related application being owned by the same assignee.

BACKGROUND OF THE INVENTION

The present invention relates to a reloadable ribbon cassette system. More particularly, the invention relates to a ribbon cassette of the type which includes reloadable ribbon spools, in which a supply spool for unwinding the ribbon and a take-up spool for winding the ribbon up are rotatably mounted on bearing pins in the cassette, which includes a foldable cover provided with an opening, with the free end of the ribbon of the full supply spool being provided with a fastening element for threading the ribbon around reversal points in the cassette and for fastening to the core of the take-up spool.

U.S. Pat. No. 3,731,781 discloses a removable cassette for a carbon ribbon to be used in a printer having a rotatable drive element for ribbon advance, with the cassette being composed of a housing accommodating a ribbon supply spool and a take-up spool. A pivotal feed roller equipped with a sprocket wheel cooperates with a take-up spool disposed on a stationary axis to wind up the carbon ribbon. For exchanging the cassette, the feed roller and the sprocket wheel must first be put out of engagement with the take-up spool. This exchange process requires a plurality of manipulations since, after insertion of the new cassette in the receptacle of the machine, the feed roller must be brought back into engagement with the take-up spool.

U.S. Pat. No. 4,010,839 discloses a ribbon cassette for a typewriter or office machine of a similar construction in which the feed roller and its sprocket wheel are also disposed in the cassette. The feed roller remains in constant engagement with the carbon ribbon on the take-up spool. In this way it is possible to exchange ribbon cassettes with only one hand. This prior art ribbon cassette is very expensive since the members for driving the carbon ribbon contained in the ribbon cassette are discarded together with the ribbon when it is used up. Since, moreover, the feed roller is always in engagement with the take-up spool and the drive elements are mounted in the bottom portion and in the cover, which is fixed to the bottom portion, it is not possible to exchange the supply and take-up spools.

Additionally, U.S. Pat. No. 4,780,010, issued Oct. 25th, 1988, discloses a ribbon cassette for office machines in which the supply and take-up spools are arranged to be exchangeable. This makes it possible to exchange only the ribbon spools if the ribbon is used up. The drawback of this cassette is that the ribbon can be threaded incorrectly within the cassette and interfere with the ribbon drive.

SUMMARY OF THE INVENTION

It is an object of the invention to provide a ribbon cassette having reloadable ribbon spools so as to ensure easy connection of the ribbon with the take-up core, whereupon the printing process can take place unimpededly until the newly inserted ribbon is used up.

This and other objects which will become apparent in the ensuing detailed description can be attained by providing a reloadable ribbon cassette of the type mentioned in the introductory paragraph of this specification, the cassette being characterized in that the take-up spool core has a bearing bore and is mounted so as to be rotatable about a bearing pin and by means of a bearing surface on a contact surface, the contact surface being disposed at the ribbon closely below a receiving bore for the fastening element.

In view of the fact that the contact surface for the take-up spool core is arranged around the bearing pin, the coiled ribbon is given secure contact and an abutment surface is provided for the fastening element when it is inserted into the receiving bore. The free end of the fastening element then does not interfere with the winding process. This advantageous feature considerably facilitates the threading of the fastening element in the receiving bore of the take up spool core.

BRIEF DESCRIPTION OF THE DRAWINGS

FIG. 4 is a perspective view showing a blocking lever and a segment of a toothed blocking disc.

FIG. 5 is a perspective view showing a receptacle with cutting edge drivable by a not shown motor.

DESCRIPTION OF THE PREFERRED EMBODIMENTS

Figure 1:
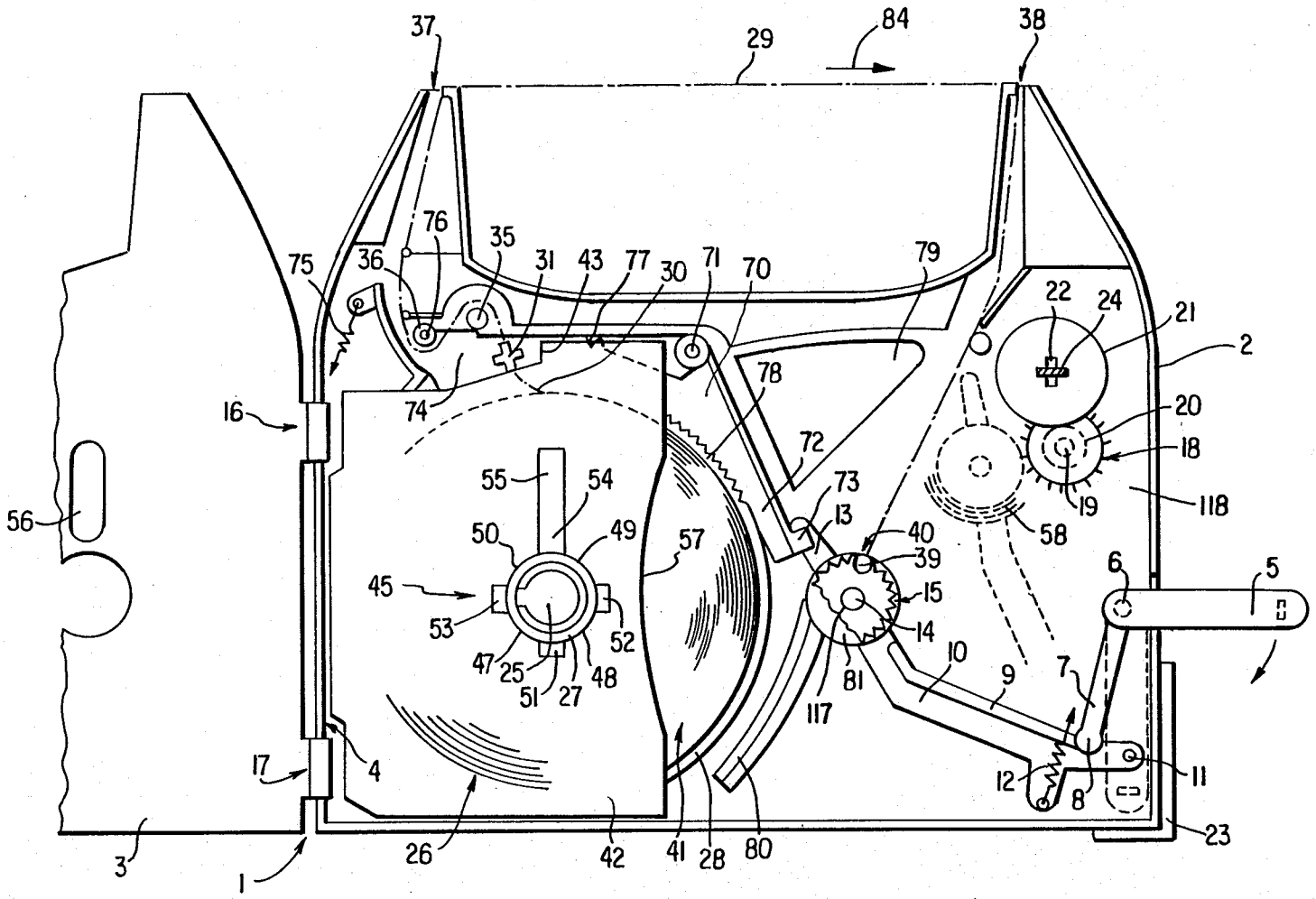
FIG. 1 is a top view showing a reloadable cassette in accordance with the invention with its cover open, a portion of the cover being broken away.

FIG. 1 shows a reloadable ribbon cassette 1 composed of a cup-shaped bottom member 2 and a cover 3 which closes the opening of bottom member 2. Cover 3 is articulated to the side wall 4 of bottom member 2 and can be releasably latched to the bottom member 2 by a catch lever 5, which is pivotal about an axis 6 in the bottom member 2. Such releasable latching can be accomplished by providing a latch opening (not illustrated) in cover 3, the latch opening being positioned so that catch lever 5 overlaps the outer surface of cover 3 when the latter is closed and catch lever 5 is rotated to the position shown in dotted lines, and so that catch lever 5 is clear of cover 3 when it is positioned as shown in solid lines. Catch lever 5 has a control arm 7 whose free end 8 is in slidable form-locking engagement with the guide face 9 of a pivot lever 10. That is, the underside of free end 8 has spaced-apart projections (not illustrated) between which guide face 9 extends, thereby slidably retaining free end 8 in a channel between the projections. Pivot lever 10 is biased clockwise about an axis 11 by a spring 12, which extends over guide face 9 and is positioned so as not to interfere with the movement of control arm 7. Inward of an abutment 13 at the free end of pivot lever 10, a take-up spool core 15 is mounted so as to be rotatable about a bearing pin 14 extending from pilot lever 10. In FIG. 1 a portion of core 15 is broken away to permit illustration of contact surface 81, which will be discussed later.

In FIG. 1, catch lever 5 as shown using solid lines is in the pivoted-out position, in which cover 3 is released and is freely pivotal into the open or closed position about hinges 16 and 17. In this position of catch lever 5, take-up spool core 15 is also held out of engagement with the teeth 18 of a feed roller 19. Feed roller 19 is fixed to a gear 20 which is in constant engagement with a drive gear pinion 21 (which, although not illustrated in FIG. 1, has gear teeth which mesh with corresponding teeth on gear 20). When catch lever 5 is in the pivoted-in position shown in dotted lines, pilot lever 10 carries spool core 15 toward the right as illustrated in dotted lines, so that the teeth 18 resiliently engage take-up spool core 15 or ribbon that has already been wound onto core 15. This resilient engagement with the rotating feed roller 19 causes take-up spool core 15 to also rotate, thereby winding more ribbon onto it. Drive pinion 21 has a cross-shaped slit 22 which can be coupled in a form-locking manner with a cutting edge 24 drivably mounted in receptacle 23 showing in FIGS. 1 and 5. The cutting edge 24 is drivable by a not shown motor in a well known manner. When the ribbon cassette 1 is positioned on the receptacle 23, the cutting edge 24 will be automatically coupled with the cross-shaped slit 22 of the drive pinion 21.

Figure 2:
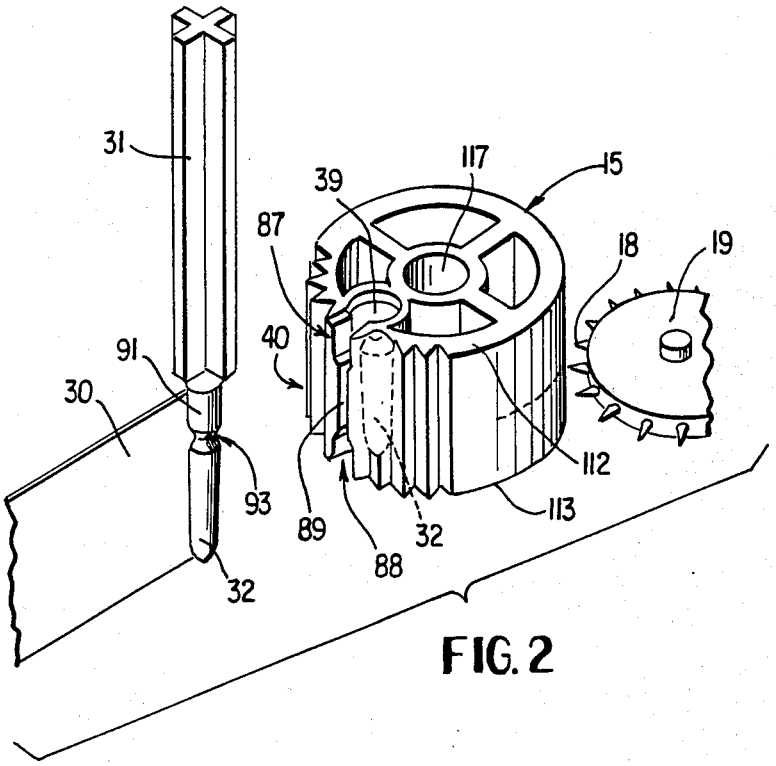
FIG. 2 is a perspective view showing a fastening element which is being carried by a guide pin toward a take-up spool core in accordance with one embodiment.

Referring next to both FIGS. 1 and 2, bottom member 2 has a further bearing pin 25 for a supply spool 26 on whose core 27 there is disposed the supply coil 28 of an inked ribbon 30. The free end of ribbon 30 is attached to a fastening element 32 which, for example, has a cylindrical shape. In this application it will be understood that the "free end" of a ribbon refers to the end of the ribbon itself, if no leader is used, or to the end of the leader if one is attached to the ribbon. Fastening element 32 is detachably connected to a projection 91 extending from a guide pin 31, which serves as a handle. With the aid of guide pin 31, ribbon 30 can be manually pulled along a ribbon path 29 (shown with a dot-dash line) which extends around guide pin 35 and guide roller 36, out of exit opening 37 and into entrance opening 38, and to take-up spool core 15. To attach ribbon 30 to take-up spool core 15, core 15 is provided with a receiving bore 39 for the fastening element 32 and a passage 40 for ribbon 30. After fastening element 32 has been lodged in receiving bore 39, it is broken away from projection 91 of guide pin 31. It should be noted that, although FIG. 2 illustrates grooves at the periphery of take-up spool core 15 only in the region of ribbon passage 40, this has been done merely to simplify the drawing and in actuality such grooves extend all the way around take-up spool core 15.

A cover plate 42 (FIG. 1) is placed onto the top face 41 of supply spool 26, and is inserted along with supply spool 26 into cassette 1 during the reloading process. Cover plate 42 projects beyond top face 41 of supply spool 26, at least in the region of a contact shelf 43, so that removal of the first turns of ribbon 30 is blocked in the axial direction as supply coil 28 is being transferred to cassette 1 for loading. That is, contact shelf 43 is positioned at the free end of ribbon 30 before loading and provides a support against which fastening element 32 can be held during the transfer to cassette 1, thereby helping to steady fastening element 32 in the hands of the person who is loading cassette 1. Cover plate 42 is additionally provided with an outer contour which corresponds to the inner contour of cassette 1 so that, after supply spool 26 has been inserted into cassette 1, cover plate 42 is mounted so as to be secured against rotation.

Core 27 of supply spool 26 is taller than the thickness of supply coil 28, thereby providing a hollow cylindrical handle 45 which projects upward from top face 41 of supply coil 28. Cover plate 42 is provided with a central recess into which inwardly projecting centering tabs 47, 48, 49, and 50 extend. Handle 45 protrudes through the recess in cover plate 42. Between centering tabs 47, 48, 49 and 50, cutouts 51, 52, 53, and 54 extend radially from the central recess. Cutout 54 is elongated to provide an extended recess 55 which serves as a viewing slit and, if the cover 3 is closed, is disposed flush with a viewing slit 56 in cover 3.

In order to realize a compact configuration of the ribbon cassette 1, cover plate 42 is provided with a recess 57 for coil 58 on take-up spool core 15. The full coil 58 on core 15 then projects into recess 57 of cover plate 42. For that reason, recess 57 is constructed to be concave with respect to the core 27 of supply spool 26.

Pivot lever 10 has a circular contact surface 81 concentric with bearing pin 14 for take-up spool core 15. Contact service 81 limits the insertion of fastening element 32. After insertion, guide pin 31 is separated from fastening element 32 by breaking it off at a notch 93.

As will be noted in FIG. 1, contact surface 81 is configured so that the axis of receiving bore 39 extends through contact surface 81 when bore 39 is oriented toward entrance opening 38 as shown (and, indeed, with the configuration shown in FIG. 1 it will be apparent that the axis of bore 39 would extend through contact surface 81 regardless of the angular position of core 15).

The coil 58 on take-up spool core 15 is supported as its diameter increases on raised surfaces 79 and 80 in bottom member 2. These surfaces are arranged in the vicinity of the circumference of a toothed blocking disc 78, which rotates together with the supply spool 26. Although teeth are illustrated on only a portion of the periphery of blocking disc 78, this has been done merely to simplify the drawing and it will be understood that in practice teeth extend all the way around the periphery of blocking disc 78. A blocking tooth 77 of a blocking lever 70, which is biased by a spring 75, can be brought into engagement with the teeth of blocking disc 78. Blocking lever 70 is pivotal about an axis 71 in bottom member 2 and has two arms 72 and 74. A bearing pin 76 for guide roller 36, which is configured as a ribbon reversal point or ribbon guide point, is disposed on arm 74 of blocking lever 70. The second arm 72 of blocking lever 70 has an abutment face 73 which is positioned for engagement by abutment arm 13 of pivot lever 10. If catch lever 5 is pivoted out into the position shown in solid lines, pivot lever 10 is pivoted counterclockwise about axis 11 and, by way of its abutment arm 13, pivot lever 70 is pivoted clockwise about bearing axis 71. This causes coil 58 of ribbon that has been wound onto take-up spool core 15 to go out of engagement with teeth 18 of feed roller 19 and blocking tooth 77 to go out of engagement with the teeth of toothed blocking disc 78. When pivot lever 10 again takes up the position shown in dotted lines in FIG. 1, spring 12 causes take-up spool core 15 to again lie resiliently against feed roller 19. Additionally, blocking tooth 77 is again engaged with the teeth of blocking gear 78. If feed roller 19 is driven by drive gear pinion 21, take-up spool core 15 is turned clockwise, thus moving ribbon 30 by one step in the direction of arrow 84. The increasing tension in ribbon 30 causes blocking lever 70 to be pivoted clockwise, thus bringing blocking tooth 77 out of engagement with the teeth of blocking gear 78. This releases supply spool 26 for unwinding. As soon as the tension in ribbon 30 decreases, blocking lever 70 at once returns to its blocking position. Since, with increasing diameter, the coil 58 on the take-up spool core 15 is supported on raised surfaces 79 and 80, the rotary movement of blocking gear 78, upon its release by blocking tooth 77, is not interfered with. The height of raised surfaces 79 and 80 is such that the coil 58 on take-up spool core 15 does not touch blocking gear 78.

Referring again to both FIGS. 1 and 2, take-up spool core 15 has a bearing bore 117 so as to be rotatable about bearing pin 14. The bottom face 113 of take-up spool 15 provides a bearing surface which is rotatable on the contact surface 81, which is disposed closely below receiving bore 39 for fastening element 32. Contact surface 81 has a circular configuration and simultaneously serves an abutment surface for fastening element 32 when it is inserted into receiving bore 39. This provides a secure end position for the inserted fastening element 32, whereupon fastening element 32 can easily be separated from a guide pin 31 by breaking it off at notch 93. The length of fastening element 32 is less than the width of take-up spool core 15, thus always placing the break point of fastening element 32, after it has been separated from guide pin 31, within the outlines of take-up spool core 15. Since fastening element 32 thus does not project from receiving bore 39, it will not interfere in any way with the rotary movement of take-up spool core 15 as ribbon 30 is being wound up. As is shown in FIG. 2, fastening element 32 is lodged into receiving bore 39 only in its center region, between the top and bottom ends of receiving bore 39 and thus within the outline of core 15. Moreover, the teeth 18 of feed roller 19 cooperate with the take-up spool core 15 only in the center region. Accordingly, it is possible for the ribbon passage 40 to be configured as a slit 89 in the region of the center of the circumference of take-up spool core 15. This also makes it possible for the slit 89 to enlarge, toward top face 112 and bottom face 113 of core 15, into widened portions 87 and 88 having intake slopes. These widened portions 87 and 88 have a width which is greater than the diameter of fastening element 32, including the ribbon 30 fastened thereto. Widened portions 87 and 88 facilitate the securing of fastening element 32 in receiving bore 39. That is, the person who is loading ribbon 30 may introduce the tip of fastening element 32 into receiving bore 39 longitudinally, through the uppermost widened portion, and then exert downward force to move fastening element 32 axially. Thereafter the person tilts guide pin 31 outward toward the widened portion to break it off. Additionally, widened portions 87 and 88 are symmetrical with the center of the circumference of take-up spool core 15, so that it is possible to place take-up spool core 15 on bearing pin 14 with either face 113 or 112 down. The machine operator can thus place take-up spool core 15 onto bearing pin 14 in any desired manner.

Figure 3:
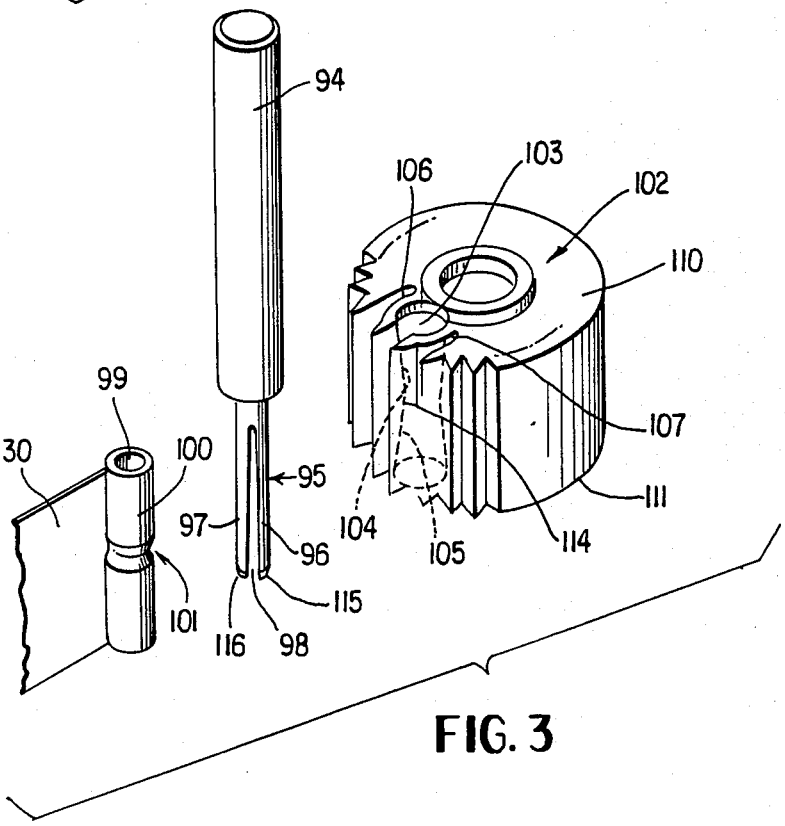
FIG. 3 is a perspective view showing a fastening element and a guide pin for carrying it toward a take-up spool core in accordance with another embodiment.

FIG. 3 shows a further possibility for easily connecting ribbon 30 to a take-up spool core 102. The fastening element is here composed of a detent sleeve 100 which can be inserted into the receiving bore 103 of take-up spool core 102 by using a guide pin 94. The center of detent sleeve 100 has a detent notch 101 for resilient engagement by detent tabs 114 provided in the center of receiving bore 103 in order to lock detent sleeve 100 in receiving bore 103. In an advantageous embodiment, receiving bore 103 is provided with conically widened portions 104 and 105 which slope outward from detent tabs 114 toward the top and bottom faces 110 and 111. This very much facilitates insertion of the sleeve 100 by guide pin 94. The walls of receiving bores 103 are made resilient by undercuts 106 and 107. This ensures secure engagement of detent sleeve 100 in receiving bore 103.

The lower end of guide pin 94 is provided with a cylindrical clamping member 95 which holds detent sleeve 100 prior to insertion. The cylindrical clamping member 95 is composed of two resilient arms 96 and 97 that are separated from one another by a slit 98. At their free ends, these resilient arms 96 and 97 are provided with threading slopes 115 and 116 which facilitate insertion of clamping member 95 into receiving bore 99 of detent sleeve 100. During the insertion of clamping member 95 into receiving bore 99, the two arms 96 and 97 are pressed together and lie in a friction lock against the inner wall of receiving bore 99. This produces reliable and releasable fastening of guide pin 94 to detent sleeve 100. After detent sleeve 100 has been inserted and locked in receiving bore 103 of take-up spool core 102, guide pin 94 can be pulled out of receiving bore 99 so that it will be available again for a later exchange of ribbon spools. Guide pin 94 is thus not discarded after one-time use.

The blocking lever 70 is showed in FIG. 4 in a perspective view. The tooth of the blocking lever 70 is shown in engagement with the teeth of the blocking gear 78, which is coupled with the supply spool 26. If blocking lever 70 is pivoted clockwise about axis 71, the tooth 77 goes out of engagement with the teeth of blocking gear 78.

The present disclosure relates to the subject matter disclosed in Federal Republic of Germany patent applications P 37 05 058.3 and P 37 42 860.8, filed respectively on February 18th, 1987 and December 17th, 1987, the entire specifications of which are incorporated herein by reference.

It will be understood that the above description of the present invention is susceptible to various modifications, changes and adaptations, and the same are intended to be comprehended within the meaning and range of equivalents of the appended claims.

What we claim is:

1. A reloadable ribbon cassette system, comprising:
- a bottom member;
- a foldable cover for the bottom member;
- a reloadable supply spool core;
- a ribbon having an end, the ribbon initially being wound on the supply spool core;
- a first bearing pin to receive the supply spool core and rotatably mount the supply spool core in the bottom member;
- an element having a contact surface and having a second bearing pin which extends from the contact surface, the element being mounted in the bottom member;
- means carried by the bottom member for defining a plurality of ribbon guide points;
- a reloadable take-up spool core having a bearing bore, a bearing surface, and an eccentrically disposed receiving bore, the take-up spool core being rotatably mountable on the element so that the second pin extends through the bearing bore and the bearing surface rests on the contact surface; and a fastening element at the free end of the ribbon for insertion into the receiving bore of the take-up spool core after the ribbon has been threaded around the ribbon guide points, the contact surface of the element being disposed closely beneath the receiving bore of the take-up spool core to limit the insertion distance of the fastening element into the receiving bore of the take-up spool core.

2. The reloadable ribbon cassette system of claim 1, wherein the contact surface is circular and serves as an abutment surface for the fastening element when the fastening element is inserted into the receiving bore of the take-up spool core.

3. The reloadable ribbon cassette system of claim 1, further comprising a guide pin to which the fastening element is detachably connected at a notched region, and wherein the receiving bore of the take-up spool core has ends and the fastening element has a length that is less than the distance between the ends of the receiving bore of the take-up spool core, so that after the fastening element has been inserted into the receiving bore of the take-up spool core and detached from the guide pin, the fastening element lies between the ends of the receiving bore of the take-up spool core.

4. The reloadable ribbon cassette system of claim 3, wherein the fastening element is configured to be lodged only in the central region of the receiving bore of the take-up spool core.

5. The reloadable ribbon cassette system of claim 4, wherein the fastening element and the take-up spool core are generally cylindrical, and wherein the take-up spool core has a ribbon passage to the receiving bore of the take-up spool core, the ribbon passage including a slit in the region of the center of the circumference of the take-up spool core, and widened portions at the ends of the slits, the widened portions having intake slopes and being symmetrical to the center of the circumference of the take-up spool core, the widened portions having a width which is greater than the diameter of the fastening element and the ribbon attached thereto.

6. The reloadable ribbon cassette system of claim 5, wherein the take-up spool core has a top side, a bottom side, and an outer peripheral surface which extends from the top side to the bottom side, and wherein the slit and the widened portions are provided in the outer peripheral surface of the take-up spool core.

7. The reloadable ribbon cassette system of claim 1, wherein the fastening element is a detent sleeve which can be locked into the receiving bore of the take-up spool core, and further comprising a guide pin to releasably hold the detent sleeve.

8. The reloadable ribbon cassette system of claim 7, wherein the detent sleeve is generally cylindrical and has a detent notch at the center of its outer circumference, and wherein the take-up spool core comprises resilient detent tabs which extend into the take-up spool core receiving bore at the center thereof to engage the detent notch.

9. The reloadable ribbon cassette system of claim 8, wherein the receiving bore of the take-up spool core has ends, and wherein the receiving bore of the take-up spool core has conically widened portions which slope from the detent tabs toward the ends of the receiving bore of the take-up spool core.

10. The reloadable ribbon cassette system of claim 9, wherein the take-up spool core has undercut regions adjacent the receiving bore of the take-up spool core to make the walls of the receiving bore resilient.

11. The reloadable ribbon cassette system of claim 7, wherein the detent sleeve has a receiving bore, and wherein the guide pin comprises a clamping member which is insertable into the receiving bore of the detent sleeve.

12. The reloadable ribbon cassette system of claim 11, wherein the clamping member comprises a pair of resilient arms which are separated from one another by a slit.

13. The reloadable ribbon cassette system of claim 12, wherein the resilient arms have ends that are provided with threading slopes.

14. A reloadable ribbon cassette system, comprising:

a bottom member having a ribbon exit opening and a ribbon entrance opening;

a reloadable supply spool core;

a ribbon having an end, the ribbon initially being wound on the supply spool core;

a first bearing pin to receiving the supply spool core and rotatably mounting the supply spool core in the bottom member;

a second bearing pin;

mounting means for mounting the second bearing pin in the bottom member;

a reloadable take-up spool core having a bearing bore, the take-up spool core being rotatably mounted on the second bearing pin, the take-up spool core having a bottom surface and having an eccentrically disposed receiving bore with an axis;

guide means carried by the bottom member for defining a plurality of ribbon guide points along a ribbon path which extends through the ribbon exit opening and the ribbon entrance opening of the bottom member;

a fastening element at the free end of the ribbon for insertion into the receiving bore of the take-up spool core after the ribbon has been threaded around the guide points; and a contact surface which is connected to the second bearing pin, slidably abuting the bottom surface of the take-up spool core to limit the insertion distance of the fastening element into the receiving bore of the take-up spool core, the contact surface being configured so that the axis of the receiving bore of the take-up spool core extends through the contact surface at least when the receiving bore of the take-up spool core is oriented toward the ribbon entrance opening of the bottom member.

15. The reloadable ribbon cassette system of claim 14, wherein the contact surface is configured so that the axis of the receiving bore of the take-up spool core extends through the contact surface at any angular position of the take-up spool core on the second bearing pin.

16. The reloadable ribbon cassette system of claim 15, wherein the contact surface has an area that is at least as large as the area of the bottom surface of the take-up spool core.

17. The reloadable ribbon cassette system of the claim 15, wherein the contact surface has an area that is substantially as large as the area of the bottom surface of the take-up spool core.

18. The reloadable ribbon cassette system of claim 14, further comprising a guide pin to which the fastening element is detachably connected at a notched region, and wherein the receiving bore of the take-up spool core has ends and the fastening element has a length that is less than the distance between the ends of the receiving bore of the take-up spool core, so that after the fastening element has been inserted into the receiving bore of the take-up spool core and detached from the guide pin, the fastening element lies between the ends of the receiving bore of the take-up core.

19. The reloadable ribbon cassette system of claim 18, wherein the fastening element is configured to be lodged only in the central region of the receiving bore of the take-up spool core.

20. The reloadable ribbon cassette system of claim 19, wherein the fastening element and the take-up spool core are generally cylindrical, and wherein the take-up spool core has a ribbon passage to the receiving bore of the take-up spool core, the ribbon passage including a slit in the region of the center of the circumference of the take-up spool core, and widened portions at the ends of the slits, the widened portions having intake slopes and being symmetrical to the center of the circumference of the take-up spool core, the widened portions having a width which is greater than the diameter of the fastening element and the ribbon attached thereto.

21. The reloadable ribbon cassette system of claim 20, wherein the take-up spool core has a top side, a bottom side, and an outer peripheral surface which extends from the top side to the bottom side, and wherein the slit and the widened portions are provided in the outer peripheral surface of the take-up spool core.

22. The reloadable ribbon cassette system of claim 14, wherein the fastening element is a detent sleeve which can be locked into the receiving bore of the take-up spool core, and further comprising a guide pin to releasably hold the detent sleeve.

23. The reloadable ribbon cassette system of claim 22, wherein the detent sleeve is generally cylindrical and has a detent notch at the center of its outer circumference, and wherein the take-up spool core comprises resilient detent tabs which extend into the take-up spool core receiving bore at the center thereof to engage the detent notch.

24. The reloadable ribbon cassette system of claim 23, wherein the receiving bore of the take-up spool core has ends, and wherein the receiving bore of the take-up spool core has conically widened portions which slope from the detent tabs toward the ends of the receiving bore of the take-up spool core.

25. The reloadable ribbon cassette system of claim 24, wherein the take-up spool core has undercut regions adjacent the receiving bore of the take-up spool core to make the walls of the receiving bore resilient.

26. The reloadable ribbon cassette system of claim 22, wherein the detent sleeve has a receiving bore, and wherein the guide pin comprises a clamping member which is insertable into the receiving bore of the detent sleeve.

27. The reloadable ribbon cassette system of claim 26, wherein the clamping member comprises a pair of resilient arms which are separated from one another by a slit.

28. The reloadable ribbon cassette system of claim 27, wherein the resilient arms have ends that are provided with threading slopes.

* * * * *